US007800310B2

(12) United States Patent
Butters et al.

(10) Patent No.: US 7,800,310 B2
(45) Date of Patent: Sep. 21, 2010

(54) END-TO-END LAMP ASSEMBLY AND METHOD OF MANUFACTURING SAME

(76) Inventors: Brian E. Butters, 340 Sovereign Road, London, Ontario (CA) N6M 1A8; Anthony L. Powell, 51 Laurel Court, London, Ontario (CA) N6H 4W2

( * ) Notice: Subject to any disclaimer, the term of this patent is extended or adjusted under 35 U.S.C. 154(b) by 313 days.

(21) Appl. No.: 12/053,161

(22) Filed: Mar. 21, 2008

(65) Prior Publication Data

US 2009/0237010 A1 Sep. 24, 2009

Related U.S. Application Data

(60) Provisional application No. 61/037,620, filed on Mar. 18, 2008.

(51) Int. Cl.
*H01J 7/44* (2006.01)

(52) U.S. Cl. ..... 315/51; 315/56; 315/63; 315/64

(58) Field of Classification Search ..... 315/51, 315/56, 63, 64; 445/22, 23
See application file for complete search history.

(56) References Cited

U.S. PATENT DOCUMENTS 5,907,218 A * 5/1999 Altman et al. ..... 315/56

* cited by examiner

*Primary Examiner*—David Hung Vu
(74) *Attorney, Agent, or Firm*—Baker & McKenzie LLP

(57) ABSTRACT

Disclosed herein are systems and methods for a lamp assembly having a novel design for fitting two or more tube-shaped lamps end-to-end. Such an end-to-end structure may be constructed for use inside a single protective sleeve, such as one constructed of transparent quartz in embodiments where the assembly is used in a decontamination reactor equipment. In exemplary embodiments, the lamps are securely coupled, or otherwise fastened or linked, together end-to-end using any appropriate means for ensuring the integrity and longevity of the connection between the ends of the lamps. The integrity of this end-to-end connection would prevail under any and all circumstances, such as shipping or otherwise moving the assembly, or under normal or abnormal operating conditions, or even in the event that any equipment in which the lamp assembly is used fails during its operation.

20 Claims, 5 Drawing Sheets

END-TO-END LAMP ASSEMBLY AND METHOD OF MANUFACTURING SAME

CROSS-REFERENCE TO RELATED APPLICATIONS

This application claims the benefit of U.S. Provisional Patent Application Ser. No. 61/037,620, filed on Mar. 18, 2008, and entitled "End-to-End Lamp Assembly," which is commonly assigned with the present application and incorporated herein by reference for all purposes.

TECHNICAL FIELD

The present disclosure relates generally to purification systems and methods, and more particularly to an end-to-end lamp assembly and method of manufacturing the same.

BACKGROUND

Since almost all forms of life need water to survive, the improvement of water quality in decontamination systems has typically been a subject of significant interest. As a result, treatment systems and techniques for removing contaminants from contaminated fluids have been developed and refined over time. Prior approaches have included water treatment by applying various microorganisms, enzymes and nutrients for the microorganisms in water. Other approaches involve placing chemicals in the contaminated fluids, such as chlorine, in an effort to decontaminate supplies. Some such systems have proved to be somewhat successful; however, sever deficiencies in each approach may still be prominent.

Some more advanced treatment systems and techniques include treatments using a photolytic or a photocatalytic process. Common photocatalytic treatment methods typically make use of a technique by which a photocatalyst is bonded to contaminants in order to destroy such biomaterials. Specifically, photocatalytic reactions are caused by irradiating, such as by ultraviolet light, on the fixed photocatalyst so as to activate it. Resulting photocatalytic reactions bring about destruction of contaminants, such as volatile organic contaminants or other biologically harmful compounds that are in close proximity to the activated photocatalyst.

This irradiation may be provided by a lamp assembly in which a tubular lamp, protected by a transparent sleeve, is inserted in a cell of a photocatalytic reactor to irradiate contaminated fluid passing through that cell. Such a lamp assembly and photocatalytic reactor may be seen in U.S. Pat. No. 5,554,300 and U.S. Published Patent Application No. 2005/0211641, both of which are commonly assigned with the present disclosure and incorporated herein by reference in their entirety for all purposes. Unfortunately, even the advanced lamp assembly designs used with such system can prove to be bulky and complex in wiring, adding to both the size of the photocatalytic equipment, as well as to the overall cost of manufacturing such a system. Accordingly, what is need is a advantageous lamp assembly design that may be used with such photocatalytic equipment, that improves the efficiency in both operation and manufacturing of the overall system.

SUMMARY

Systems and methods constructed and operated in accordance with the principles disclosed herein provide a novel design for fitting two or more tube-shaped lamps end-to-end. Such an end-to-end structure may be constructed for use inside a single protective sleeve, such as one constructed of transparent quartz in embodiments where the assembly is used in a decontamination reactor equipment. In exemplary embodiments, the lamps are securely coupled, or otherwise fastened or linked, together end-to-end using any appropriate means for ensuring the integrity and longevity of the connection between the ends of the lamps. The integrity of this end-to-end connection would prevail under any and all circumstances, such as shipping or otherwise moving the assembly, or under normal or abnormal operating conditions, or even in the event that any equipment in which the lamp assembly is used fails during its operation.

In one aspect, a multiple lamp assembly is provided. In one embodiment, the lamp assembly comprises a first lamp and a second lamp, as well as a first connector on a near end of the first lamp having first and second power terminals for electrical connection to separate first and second power lines, and having a neutral terminal for electrical connection to a ground line. In addition, the assembly may comprise a second connector on a far end of the first lamp and having a second power terminal for electrical connection only to the second power line, and having a neutral terminal for electrical connection to the ground line. In some embodiments, the assembly may also contain a jumper wire electrically bypassing the second power line around the first lamp from the first connector to the second connector. Still further, the assembly may include a third connector on a near end of the second lamp having a second power terminal for electrical connection to the second power terminal of the second connector, and having a neutral terminal for electrical connection to the neutral terminal of the second connector, wherein the third connector physically couples to the second connector to couple the first and second lamps end-to-end. Also in such embodiments, a protective sleeve hermetically sealing the first and second lamps and the connectors may be provided.

In another aspect, a lighting system is provided. In one embodiment, the lighting system comprises an electrical ballast providing separate first and second power lines and a ground line. In addition, the system may include a housing with an electrical receptacle providing the first and second power lines and the ground line, as well as a tubular lamp assembly having a mount on one end for suspending the assembly from the one end. In certain embodiments, the lamp assembly may comprise tubular first and second lamps, as well as a first connector on a near end of the first lamp having first and second power terminals for electrical connection to the first and second power lines, and having a neutral terminal for electrical connection to the ground line. The lamp assembly may also include a second connector on a far end of the first lamp and having a second power terminal for electrical connection only to the second power line, and having a neutral terminal for electrical connection to the ground line. A jumper wire electrically bypassing the second power line around the first lamp from the first connector to the second connector may also be provided, wherein the jumper wire is disposed on an external surface of the first lamp. Also, the lamp assembly may provide a third connector on a near end of the second lamp having a second power terminal for electrical connection to the second power terminal of the second connector, and having a neutral terminal for electrical connection to the neutral terminal of the second connector, wherein the third connector physically couples to the second connector to couple the first and second lamps end-to-end. The lamp assembly may also include a protective sleeve connected to the mount and hermetically sealing the first and second lamps and the connectors. Finally, the lighting system may include an electrical coupling configured to electrically connect the mount to the electrical receiver on the housing.

In yet another aspect, a method of manufacturing a lamp assembly is provided. In one embodiment, the method comprises electrically connecting first and second power terminals of a first connector on a near end of a first lamp to separate first and second power lines, and electrically connecting a neutral terminal of the first connector to a ground line. The method may also include electrically connecting a second power terminal of a second connector on a far end of the first lamp to only the second power line, and electrically connecting a neutral terminal of the second connector to the ground line. Still further, such a method may include electrically bypassing the second power line around the first lamp from the first connector to the second connector. Also, the method may provide for electrically connecting a second power terminal of a third connector on a near end of the second lamp to the second power terminal of the second connector, and electrically connecting a neutral terminal of the third connector to the neutral terminal of the second connector. Additionally, in such embodiments, the method may also comprise physically coupling the third connector to the second connector to couple the first and second lamps end-to-end. Then, such a method could include connecting a protective sleeve to a mount configured to suspend the assembly from one end to hermetically seal the first and second lamps and the connectors, the mount providing the first and second power lines and the ground line to the first connector.

BRIEF DESCRIPTION OF THE DRAWINGS

Embodiments are illustrated herein by way of example in the accompanying figures, in which like reference numbers indicate similar parts, and in which.

DETAILED DESCRIPTION

Figure 1:
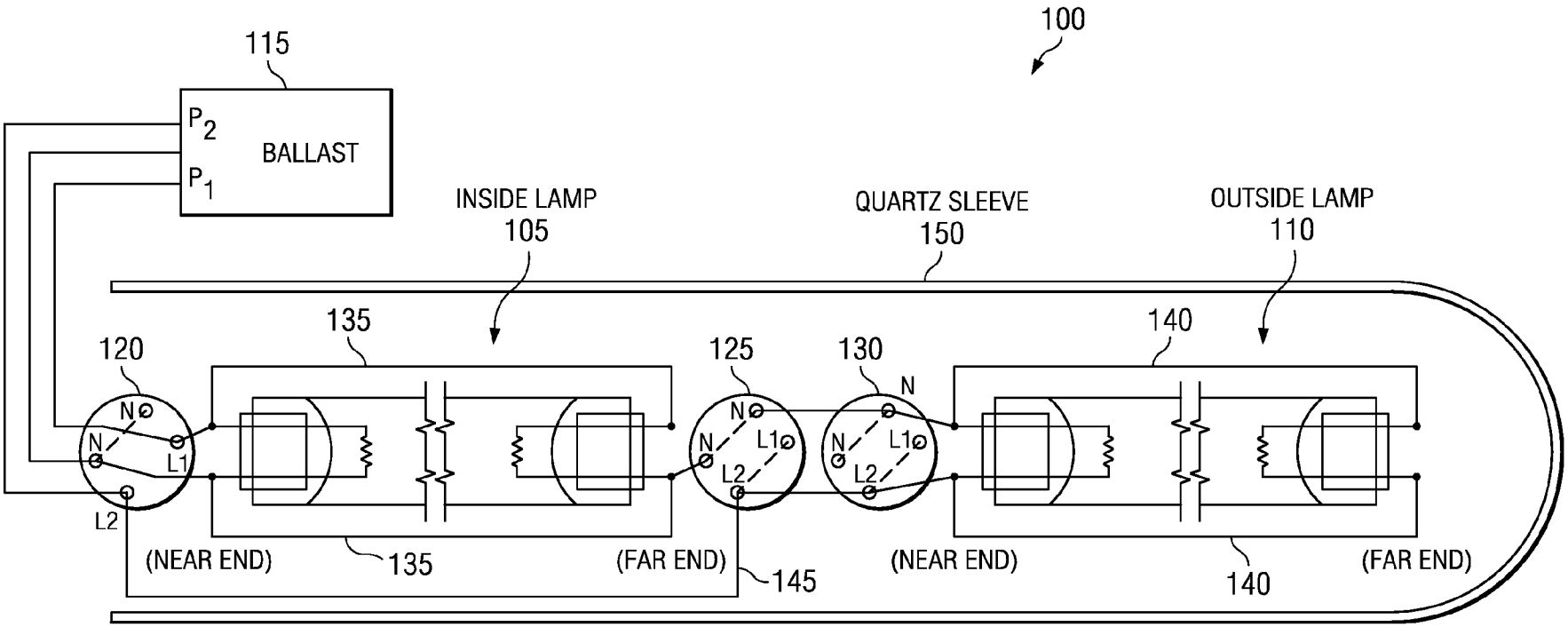
FIG. 1 illustrates one embodiment of an end-to-end lamp assembly constructed according to the principles disclosed herein.

The present disclosure provides a novel design for fitting two lamps end-to-end. Such an end-to-end structure may be constructed for use inside a single protective sleeve and held from only one end, such as for use in reactors found in decontamination equipment. Looking initially at FIG. 1, illustrated is one embodiment of an end-to-end lamp assembly 100 constructed according to the principles disclosed herein. The disclosed end-to-end lamp assembly 100 includes two lamps 105, 105 in a single assembly to be powered from only one end of the end-to-end lamps 105, 110 by a single electrical ballast 115. In exemplary embodiments, these lamps 105, 110 may be ultraviolet (UV) lamps, but other types of lamps 105, 110 may also be employed.

In an advantageous embodiment, the near end of the inside lamp 105, which is the lamp 105 closest to the ballast 115, would first be plugged into the ballast 115 in a normal manner. For example, this near end may have a four-terminal connector 120, and the ballast 115 has a receiving connector, such a Gaynor connector (not illustrated). The far end of the inside lamp 105 could also include a four-terminal connector 125. The outside lamp 110, which is the lamp 110 furthest from the ballast 115, may also include a four-terminal connector 130 on its near end. Of course, for either or both lamps 105, 110, different types or numbers of connectors or terminals may also be employed, so long as the power relay around the inside lamp 105 as discussed below is provided. Accordingly, although the terminals on the connectors are illustrated as pins or pin receivers, other shapes and types of terminals and connectors may be employed without departing from the spirit and scope of the present disclosure.

The four-terminal connectors 120, 125, 130 illustrated in FIG. 1 may be provided as two power or "line" terminals (denoted L1 and L2 in FIG. 1) and two neutral terminals (denoted N in FIG. 1). In addition, the neutral terminals N in each connector 120, 125, 130 may be electrically connected together, while the line terminals in the second and third connectors 125, 130 may be likewise electrically connected. However, the line terminals in the first connector 120 are electrically isolated, with one line terminal L1 electrically connected to a first power line P1 from the ballast 115, and the other line terminal L2 electrically connected to a second power line P2 from the ballast 115. The neutral terminals on the first connector 120 are thus electrically connected to a ground line from the ballast 115.

Continuing with FIG. 1, the first power line L1 and the neutral line N are electrically connected to two electrical connections 135 of the inside lamp 105. These two connections 135 power a filament on the near end of the inside lamp 105 and are jumpered around the outside casing of this lamp 105 to a filament at its far end in order to provide the power to cause the inside lamp 105 to illuminate. The electrical connections 140 and filaments for the outside lamp 110 are similarly wired. Thus, each of the lamps 105, 110 may include electrical connections 135, 140 jumpered on the outside of their casings, however, it should be noted that such an electrical layout is not required. In other embodiments, the lamps 105, 110 may be provided with different means for providing electricity to both ends of the lamps 105, 110.

In accordance with the disclosed principles, the outside lamp 110 is electrically connected to the inside lamp 105 to receive its power, rather than being directly connected to the ballast 115. More specifically, as discussed above, the second power line P2 from the ballast 115 is connected to the second power terminal L2 in the first connector 120 at the near end of the inside lamp 105. The second power line P2 may then be jumpered around the inside lamp 105 via an electrical jumper wire 145 to one of the two power terminals L1, L2 of the second connector 125 located at the far end of the inside lamp 105. In addition, the ground connection is also provided to the neutral terminals N of the second connector 125. By providing the second power line P2 and a ground connection N to the second connector 125 fixed on the far end of the inside lamp 105, the near end of the outside lamp 110 can then receive its power directly from the second connector 125.

To seal and protect the lamps 105, 110 and all of the electrical connections in the assembly 100, a protective sleeve 145, such as a transparent sleeve, may be provided for the assembly 100. In embodiments employing a transparent sleeve 145, the end-to-end lamp assembly 100 is ideal for use in the reactors found in some types of decontamination/purification equipment. For example, a photocatalytic reactor like the ones found in U.S. patent and pending U.S. patent application cited above, would benefit from a lamp assembly 100 constructed as disclosed herein.

Figure 2:
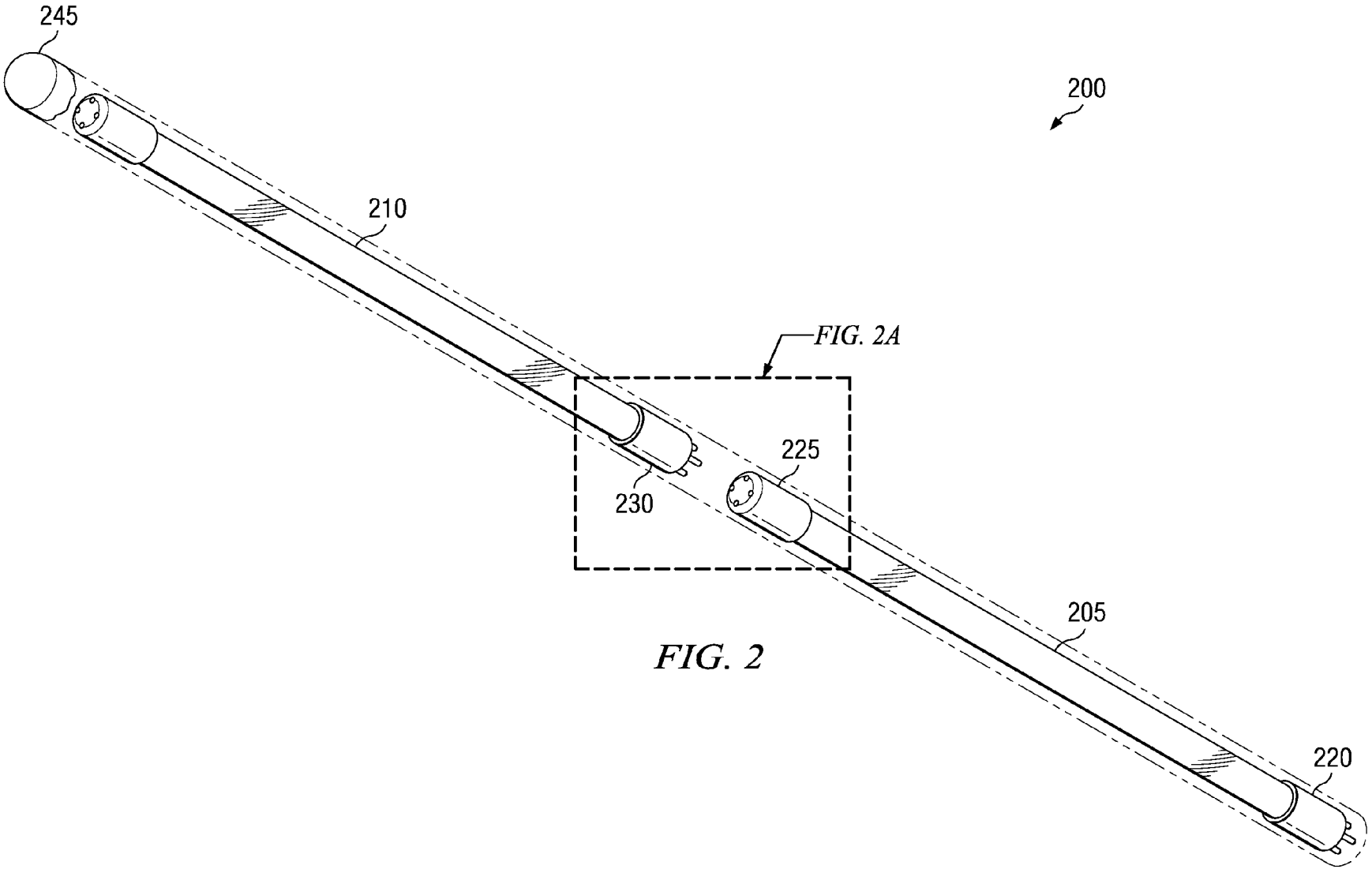
FIG. 2 illustrates an isometric view of an embodiment of the end-to-end lamp assembly disclosed herein similar to the assembly shown in FIG. 1.

Turning to FIG. 2, illustrated is an isometric view of an embodiment of the end-to-end lamp assembly 200 disclosed herein similar to the assembly 100 shown in FIG. 1. The assembly 200 in FIG. 1 also includes inside and outside lamps 205, 210, which are again protected within a sleeve 245. In addition, this embodiment of the assembly 200 includes the inside and outside lamps 205, 210 interconnected using first, second and third electrical connectors 220, 205, 230.

Figure 2A:
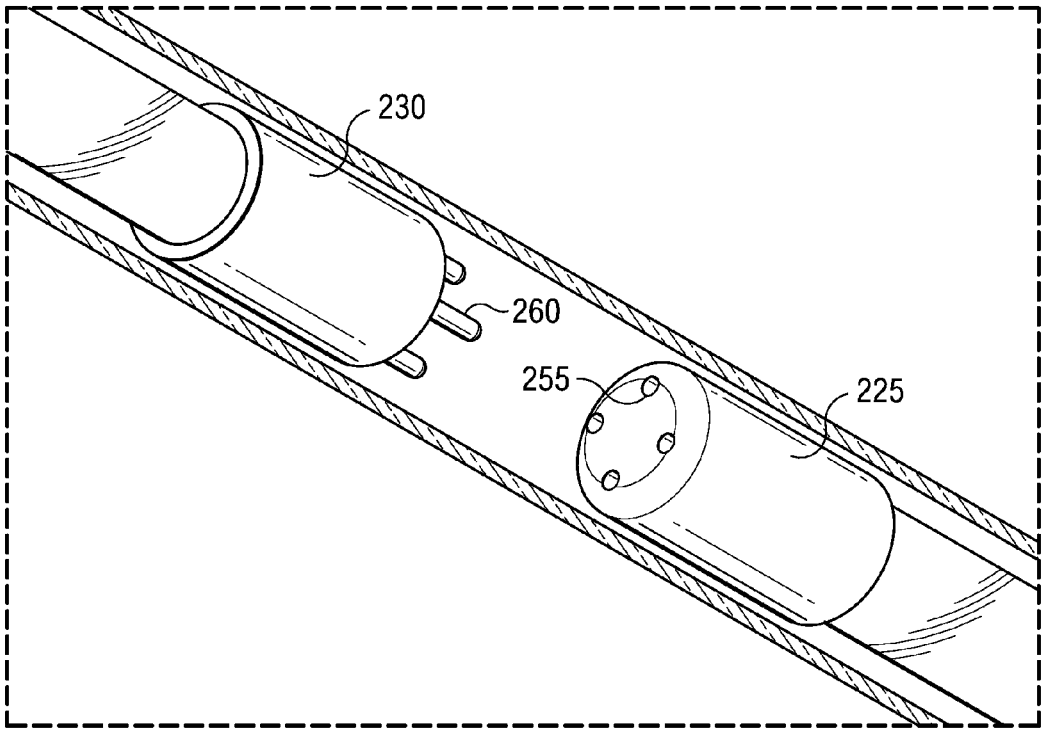
FIG. 2A illustrates a close-up view of the joint between the inside and outside lamps created by the second and third connectors.

As before, the first connector 220 is located at the near end of the inside lamp 205, the second connector 225 is located at the far end of the inside lamp 205, and the third connector 230 is located at the near of the outside lamp 210. FIG. 2A provides a close-up view of the joint between the inside and outside lamps 205, 210 created by the second and third connectors 225, 230. As illustrated, the second connector 225, located on the far end of the inside lamp 205, may comprise four female terminals 255, while the third connector 230, located on the near end of the outside lamp 210, may include four male terminals 260 configured to be plugged into the four female terminals 255 on the second connector 225.

As with the assembly 100 in FIG. 1, the four-terminal connectors 225, 230 illustrated in FIG. 2A may be provided as two power or "line" terminals (denoted L1 and L2 in FIG. 1) and two neutral terminals (denoted N in FIG. 1). As described above, the line terminals in the second connector 225 provide electricity from second power line P2 of the ballast 115, which is distinct from the first power line P1 provided to operate the inside lamp 205. The electricity from the second power line P2 is then provided to the outside lamp 210 via one or both of the male line terminals in the third connector 230. Also, the neutral terminals on the second connector 225 are electrically connected to the ground line from the inside lamp 205, and that electrical ground is also provided to the outside lamp 210 via male neutral terminals on the third connector 230 when the outside lamp 210 is plugged into the inside lamp 205.

As a result of the disclosed electrical interconnection of the inside and outside lamps 205, 210, the tubular lamps 205, 210 are physically connected to each other in series, or end-to-end, while these same lamps 205, 210 are each separately electrically connected using the jumper wire (145 in FIG. 1) to bypass the inside lamp 205. In advantageous embodiments, the ballast 115 may provide only a single output power, but this type of interconnection allows multiple lamps to be powered by that single output power in parallel. By being electrically connected in parallel, each lamp 205, 210 would thus operate with the same voltage while still being physically connected in "series" to one another. As a result, the disclosed assembly may take advantage of an in-line physical layout for multiple lamps, while maintaining the advantages of a parallel electrical configuration. Additionally, in embodiments where more than two lamps 205, 210 are employed, the second power line P2 is provided to lamp 210 via only one of the line terminals in the second and third connectors 225, 230, while a third power line (not illustrated) may be provided around both of the illustrated lamps 205, 210 to a third lamp (not illustrated).

Among the other advantages a lamp assembly constructed according to the disclosed principles provides is that this unique design allows two or more lamps to be encased in a single protective sleeve, without additional wires or seals or process connections, thus reducing manufacturing costs. By connecting two or more lamps end-to-end, 50% less (or greater with more lamps in series) of the total number of protective sleeves, lamp plugs, seal, wiring harnesses, etc. are needed tubes thus, increasing the packing density of the equipment employing the lamp assembly. Also, by increasing the packing density, the overall footprint of the equipment may be reduced. Furthermore, the disclosed principles may reduce the complexity of the overall assembly, as well as the time required for assembly since there are less connections and quality control inspections to be performed. A reduction in the amount of time required for maintenance activities may also be realized. In sum, all of these advantages may come together to help improve the overall cost of the equipment by employing an assembly as disclosed herein that improves the efficiency in both operation and manufacturing of the overall system.

Figure 3A:
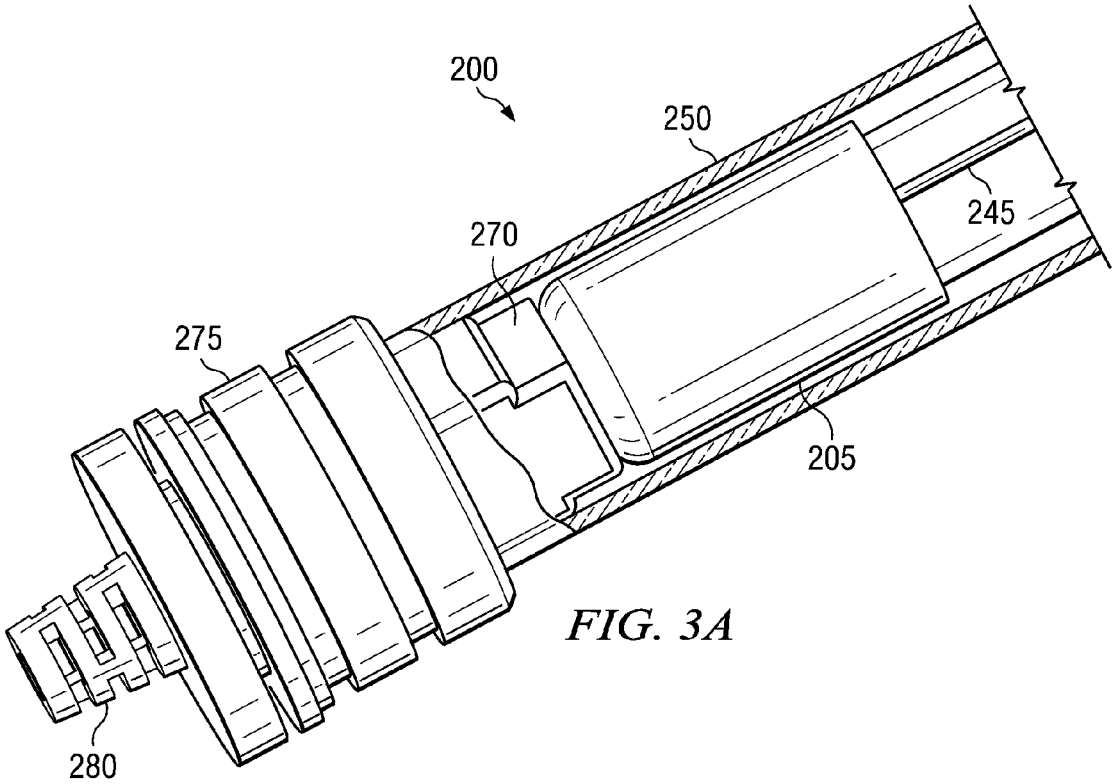
FIG. 3A illustrates a detailed view of the near end of the embodiment of an end-to-end lamp assembly shown in FIGS. 2 and 2A.
Figure 3B:
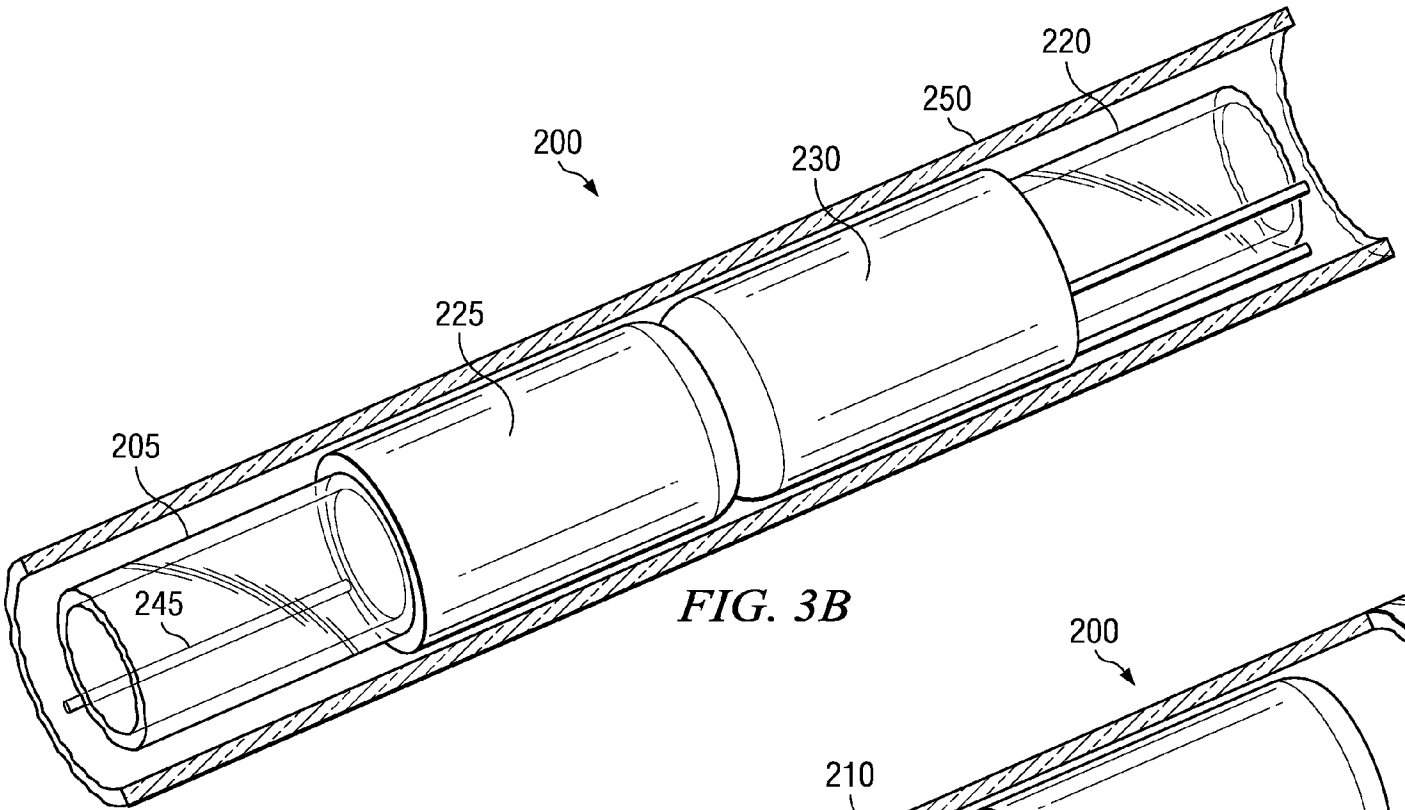
FIG. 3B illustrates a detailed view of the middle section of the embodiment of an end-to-end lamp assembly shown in FIGS. 2 and 2A.
Figure 3C:
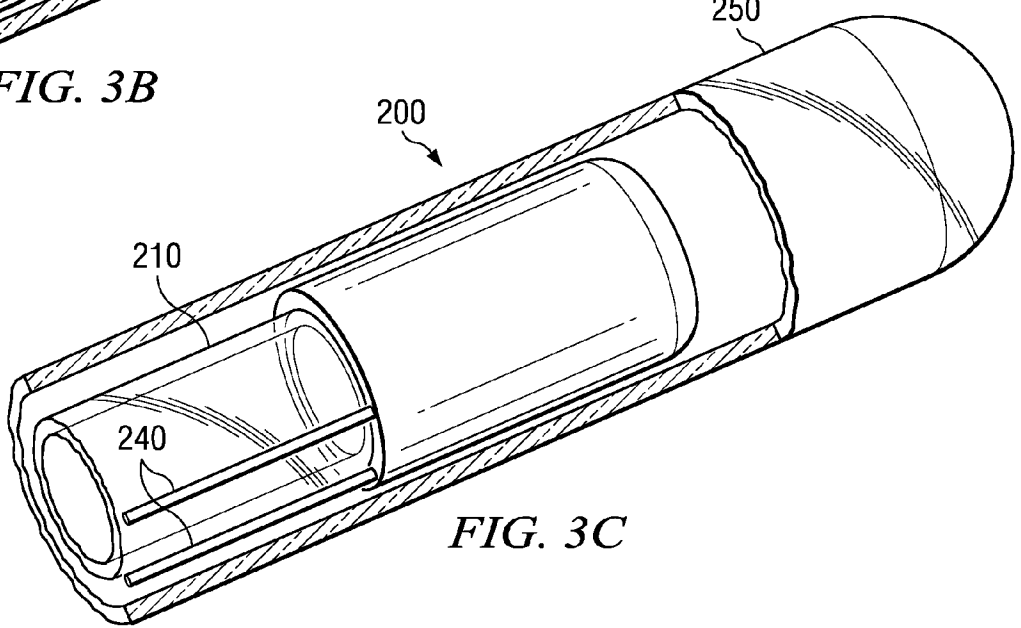
FIG. 3C illustrates a detailed view of the far end of the embodiment of an end-to-end lamp assembly shown in FIGS. 2 and 2A.

FIGS. 3A-3C illustrate multiple detailed views of the near end, middle, and far end of the embodiment of an end-to-end lamp assembly 200 shown in FIGS. 2 and 2A. As discussed above, this assembly 200 employs inside and outside lamps 205, 210 physically connected end-to-end in series, while each is powered by distinct power lines. To seal and protect the lamps 205, 210 and all of the electrical connections in the assembly 200, the protective sleeve 245 is provided over the components of the assembly 200.

In this embodiment, the two lamps 210, 220 are coupled together with male electrical terminals in the third connector 230 plugging in to female terminals in the second conductor 225 (see FIG. 2B). The coupling of these two connectors 225, 230 provides the electrical connection from the ballast 115 to the outside lamp 210. Specifically, the jumper wire 245 is provided from the second power line P2 of the ballast 115 to a line terminal in the second connector 225 at the far end of the inside lamp 205. That line terminal is then electrically coupled to a line terminal of the third connector 230, and thus the electricity from the second power line P2 bypasses the inside lamp 205 and provided to the outside lamp 210. As shown in FIG. 3C, the lamps 205, 210 may also include external wires 240 provided down the outside casing of the lamps 205, 210 to provide electricity at both ends of the lamps 205, 210. As mentioned above, however, different wiring for each illuminating lamp 205, 210 individually may also be provided instead of external return wires 240.

Figure 4:
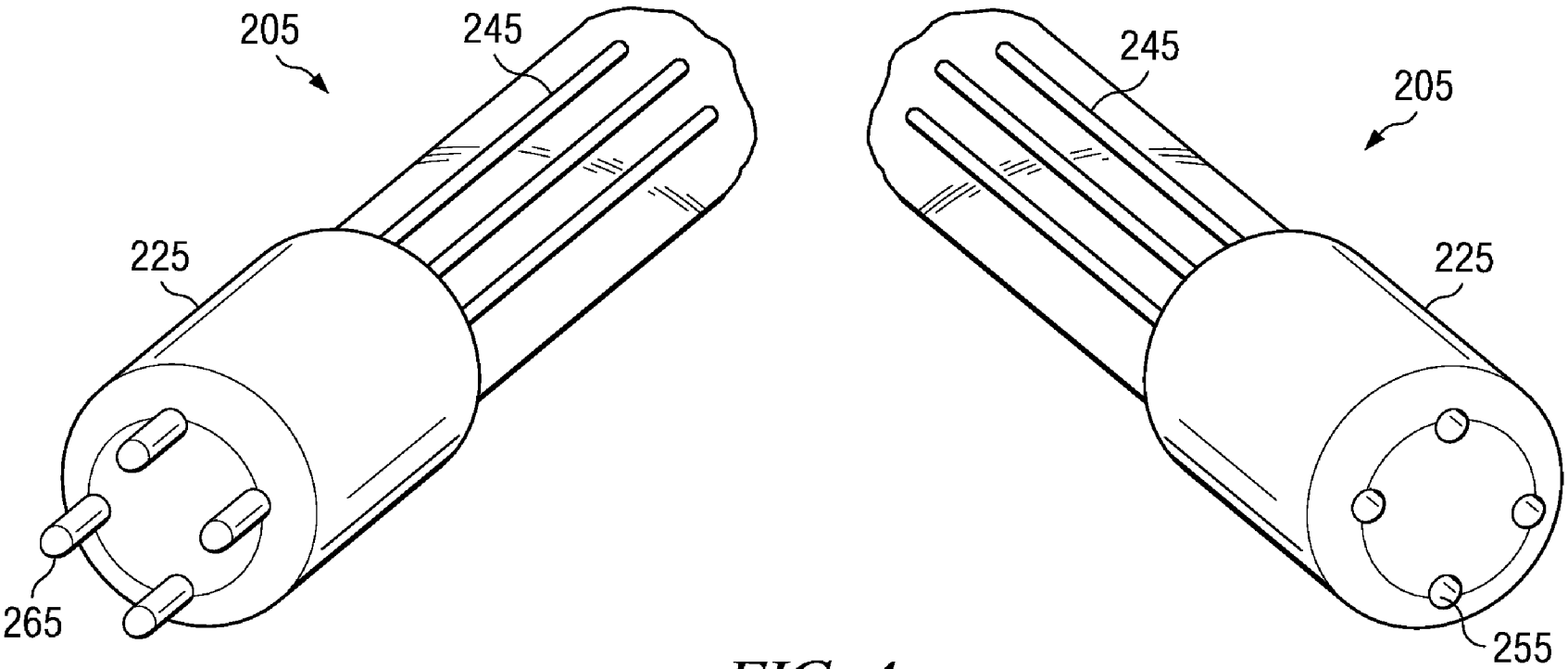
FIG. 4 illustrates isometric views of the near and far ends of the inside lamp depicted in the assembly of FIGS. 2 and 2A.

In addition, looking at FIG. 3A in combination with FIG. 4, which illustrates views of the near and far ends of the inside lamp 205, the first connector unit 220 may also include four male terminals 265 (see FIG. 4) extending from the near end of the inside lamp 205. These terminals 265 on the near end of the inside lamp 205 may be configured to plug into receiving terminals electrically connected to the ballast 115. These receiving terminals may be provided in a standard Gaynor connector 270, but of course any type of connector configured to receive the terminals 265 of the first connector 225 may be employed. The Gaynor connector 270 may then be coupled to a mount 275 configured to receive and secure the protective sleeve 250 in place. This mount 275 could be constructed to house the ballast 115 inside, or could include an electrical connector 280 of its own that is electrically coupled to the ballast 115. In addition to the benefits of the disclosed assembly 200 discussed above, such a construction allows the lamps 210, 220 to be powered from only one end, which then further allows the entire assembly to be held from only one end. Accordingly, an assembly 200 constructed according to the principles of the present disclosure is capable of being inserted into other fixtures for use in various types of machinery, when being attached and powered for only the exposed end.

While various embodiments in accordance with the disclosed principles have been described above, it should be understood that they have been presented by way of example only, and are not limiting. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically and by way of example, although the headings refer to a "Technical Field," such claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings herein.

What is claimed is:

1. A multiple lamp assembly, comprising:

at least a first lamp and a second lamp;

a first connector on a near end of the first lamp having first and second power terminals for electrical connection to separate first and second power lines, and having a neutral terminal for electrical connection to a ground line;

a second connector on a far end of the first lamp and having a single power terminal for electrical connection only to the second power line, and having a neutral terminal for electrical connection to the ground line;

a jumper wire electrically bypassing the second power line around the first lamp from the first connector to the second connector;

a third connector on a near end of the second lamp having a single power terminal for electrical connection to the single power terminal of the second connector, and having a neutral terminal for electrical connection to the neutral terminal of the second connector, wherein the third connector physically couples to the second connector to couple the first and second lamps end-to-end; and a protective sleeve hermetically sealing the first and second lamps and the connectors.

2. A lamp assembly according to claim 1, wherein the jumper wire bypasses the first lamp on an external surface of the first lamp.

3. A lamp assembly according to claim 1, wherein the protective sleeve is a quartz sleeve.

4. A lamp assembly according to claim 1, wherein an interconnection of the power terminal and neutral terminal of the third connector with the power terminal and neutral terminal of the second connector provides the physical coupling of the second lamp to the first lamp.

5. A lamp assembly according to claim 1, wherein the first and second lamps are ultraviolet lamps.

6. A lamp assembly according to claim 1, wherein the single power terminal and neutral terminal of the second connector are female terminals, and the single power terminal and neutral terminal of the third connector are male terminals, the single power terminal and neutral terminal of the third connector received within the single power terminal and neutral terminal of the second connector.

7. A lamp assembly according to claim 1, wherein the first and second power terminals and the neutral terminal of the first connector are male terminals.

8. A lamp assembly according to claim 7, wherein the male terminals of the first connector engage a mount on which the protective sleeve is mounted, the mount suspending the assembly from one end and providing the first and second power lines and the ground line to the first connector.

9. A lamp assembly according to claim 8, wherein the mount further comprises an electrical coupling electrically connecting the assembly to the first and second power lines and the ground line.

10. A lighting system, comprising:

an electrical ballast providing separate first and second power lines and a ground line;

a housing with an electrical receptacle providing the first and second power lines and the ground line;

a tubular lamp assembly having a mount on one end for suspending the assembly from the one end, the lamp assembly comprising:

at least first and second tubular lamps, a first connector on a near end of the first lamp having first and second power terminals for electrical connection to the first and second power lines, and having a neutral terminal for electrical connection to the ground line, a second connector on a far end of the first lamp and having a single power terminal for electrical connection only to the second power line, and having a neutral terminal for electrical connection to the ground line, a jumper wire electrically bypassing the second power line around the first lamp from the first connector to the second connector, the jumper wire disposed on an external surface of the first lamp, a third connector on a near end of the second lamp having a single power terminal for electrical connection to the single power terminal of the second connector, and having a neutral terminal for electrical connection to the neutral terminal of the second connector, wherein the third connector physically couples to the second connector to couple the first and second lamps end-to-end, a protective sleeve connected to the mount and hermetically sealing the first and second lamps and the connectors; and an electrical coupling configured to electrically connect the mount to the electrical receiver on the housing.

11. A lighting system according to claim 10, wherein the protective sleeve is a quartz sleeve.

12. A lighting system according to claim 10, wherein an interconnection of the power terminal and neutral terminal of the third connector with the power terminal and neutral terminal of the second connector provides the physical coupling of the second lamp to the first lamp.

13. A lighting system according to claim 10, wherein the first and second lamps are ultraviolet lamps.

14. A lighting system according to claim 10, wherein the single power terminal and neutral terminal of the second connector are female terminals, and the single power terminal and neutral terminal of the third connector are male terminals, the single power terminal and neutral terminal of the third connector received within the single power terminal and neutral terminal of the second connector.

15. A lighting system according to claim 10, wherein the first and second power terminals and the neutral terminal of the first connector are male terminals configured to engage the mount.

16. A method of manufacturing a lamp assembly, the method comprising:

electrically connecting first and second power terminals of a first connector on a near end of a first lamp to separate first and second power lines, and electrically connecting a neutral terminal of the first connector to a ground line;

electrically connecting a single power terminal of a second connector on a far end of the first lamp to only the second power line, and electrically connecting a neutral terminal of the second connector to the ground line;

electrically bypassing the second power line around the first lamp from the first connector to the second connector;

electrically connecting a single power terminal of a third connector on a near end of the second lamp to the single power terminal of the second connector, and electrically connecting a neutral terminal of the third connector to the neutral terminal of the second connector, physically coupling the third connector to the second connector to couple the first and second lamps end-to-end; and connecting a protective sleeve to a mount configured to suspend the assembly from one end to hermetically seal the first and second lamps and the connectors, the mount providing the first and second power lines and the ground line to the first connector.

17. A method according to claim 16, wherein electrically bypassing comprises extending a jumper wire on an external surface of the first lamp from the first connector to the second connector.

18. A method according to claim 16, wherein physically coupling the third connector to the second connector comprises interconnecting the power terminal and neutral terminal of the third connector with the power terminal and neutral terminal of the second connector.

19. A method according to claim 16, wherein the single power terminal and neutral terminal of the second connector are female terminals, and the single power terminal and neutral terminal of the third connector are male terminals, the single power terminal and neutral terminal of the third connector received within the single power terminal and neutral terminal of the second connector.

20. A method according to claim 16, wherein the first and second power terminals and the neutral terminal of the first connector are male terminals, the method further comprising engaging the male terminals of the first connector with terminals on the mount providing the first and second power lines and the ground line.

* * * * *